US012426708B2

(12) United States Patent
Walton et al.

(10) Patent No.: US 12,426,708 B2
(45) Date of Patent: Sep. 30, 2025

(54) STORAGE SYSTEM

(71) Applicant: YUM Connect, LLC, Louisville, KY (US)

(72) Inventors: Eric Matthew Walton, Frisco, TX (US); Shelby Alexis Stanfield, McKinney, TX (US); Peter Gerald Graham, Lucas, TX (US); Steven Jeffery Gluck, Frisco, TX (US); Scott Alan Mestan, Frisco, TX (US)

(73) Assignee: Yum Connect, LLC, Louisville, KY (US)

( * ) Notice: Subject to any disclaimer, the term of this patent is extended or adjusted under 35 U.S.C. 154(b) by 27 days.

(21) Appl. No.: 18/529,837

(22) Filed: Dec. 5, 2023

(65) Prior Publication Data

US 2024/0180329 A1 Jun. 6, 2024

Related U.S. Application Data

(60) Provisional application No. 63/430,536, filed on Dec. 6, 2022.

(51) Int. Cl.
*A47B 96/02* (2006.01)
*A47B 96/14* (2006.01)

(52) U.S. Cl.
CPC ..... *A47B 96/02* (2013.01); *A47B 96/14* (2013.01)

(58) Field of Classification Search
CPC ..... A47B 96/02; A47B 96/14; A47B 96/027; A47B 47/00; A47F 3/00; A47F 3/007; A47F 3/06; A47F 3/14; A47F 5/0018; A47F 7/0057
See application file for complete search history.

(56) References Cited

U.S. PATENT DOCUMENTS

| | | | | |
|---|---|---|---|---|
| 1,711,329 A | | 4/1929 | Short | |
| 2,138,560 A | * | 11/1938 | Stuart | A21B 1/50 D7/610 |
| D232,681 S | | 9/1974 | Bliss | |
| 3,992,069 A | | 11/1976 | Kitterman | |
| 4,080,023 A | | 3/1978 | Bair | |
| 4,118,086 A | | 10/1978 | Kneier | |

(Continued)

FOREIGN PATENT DOCUMENTS

| | | |
|---|---|---|
| GB | 2 041 726 A | 9/1980 |
| GB | 2 104 050 B | 3/1985 |

OTHER PUBLICATIONS

Non-Final Office Action on U.S. Appl. No. 29/868,272 dtd Apr. 10, 2024.

(Continued)

*Primary Examiner* — Daniel J Rohrhoff
(74) *Attorney, Agent, or Firm* — Foley & Lardner LLP

(57) ABSTRACT

A storage system is provided that includes a top, a bottom, a front, a back, a left side wall, and a right side wall. A storage area is defined by the top, bottom, left and right side walls. A plurality of full shelves are located within the storage area and extend between the left and right side walls. A plurality of partial shelves are located within the storage area, some of the partial shelves extend from the left side wall and some of the partial shelves extend from the right side wall. Removable handles are located on the left and right side walls. A skirt extends around at least a portion of a lower side of the bottom.

20 Claims, 14 Drawing Sheets

(56) References Cited

U.S. PATENT DOCUMENTS

| | | | | | |
|---|---|---|---|---|---|
| 4,123,128 | A * | 10/1978 | Abele | A21B 3/13 | D7/610 |
| 4,269,461 | A * | 5/1981 | Roach, Jr. | B65D 85/42 | 312/111 |
| 4,463,684 | A | 8/1984 | Klungle | | |
| 4,502,741 | A | 3/1985 | Devries et al. | | |
| 4,771,907 | A | 9/1988 | Torney | | |
| D307,521 | S | 5/1990 | Rogers | | |
| D307,977 | S | 5/1990 | Egly et al. | | |
| 5,027,961 | A * | 7/1991 | Howitt | A47B 87/0253 | 211/188 |
| D337,922 | S | 8/1993 | Marshall | | |
| 5,320,244 | A * | 6/1994 | Yu | G11B 23/0236 | 220/523 |
| 5,706,966 | A * | 1/1998 | Rothe | A47F 10/06 | 312/351 |
| D408,858 | S | 4/1999 | Stravitz | | |
| D411,783 | S | 7/1999 | Kualaau | | |
| 6,030,059 | A | 2/2000 | Stravitz | | |
| D444,335 | S | 7/2001 | Stravitz | | |
| 6,630,059 | B1 * | 10/2003 | Uzoh | B24B 37/26 | 204/290.01 |
| 7,134,552 | B1 * | 11/2006 | McDonagh | A47J 47/14 | 62/3.62 |
| D661,950 | S | 6/2012 | Greenwood | | |
| 9,211,009 | B2 | 12/2015 | Greenwood | | |
| D823,392 | S * | 7/2018 | Rabinovitz | D19/92 | |
| D859,932 | S | 9/2019 | Greenwood | | |
| D860,313 | S | 9/2019 | Rabinovitz | | |
| D861,784 | S * | 10/2019 | Park | D19/92 | |
| 10,646,034 | B2 * | 5/2020 | Olson | F25D 3/06 | |
| D1,059,479 | S * | 1/2025 | Walton | D7/610 | |
| 2002/0100739 | A1 | 8/2002 | Day et al. | | |
| 2015/0068999 | A1 * | 3/2015 | Dart | A47B 57/20 | 211/186 |

OTHER PUBLICATIONS

PCT Int Search Report and Written Opinion dtd Apr. 2, 24 re PCT Appl No. PCT/US2023/082554.

Notice of Allowance on U.S. Appl. No. 29/868,272 dtd Sep. 12, 2024.

SONGWAY File Sorter Organizer for Desk_Amazon, [date first available: Sep. 10, 2020], [date found online: Nov. 1, 2023], https:/Avwww.amazon.com/SONGWAY-File-Organizer-Desk- Document/dp/BO9P87JLRV/ (Year: 2020).

WKWKER File Organizer_Amazon, [date first available: Oct. 26, 2021], [date found online: Nov. 1, 2023], https://www.amazon.com/WKWKER-Organizer-Adjustable-Document-Workstation/dp/BO9KBD751H/ (Year: 2021).

PCT Int Preliminary Report and WO dtd Jun. 19, 2025 re PCT/US2023/082554.

* cited by examiner

STORAGE SYSTEM

CROSS-REFERENCE TO RELATED APPLICATIONS

This application claims priority to U.S. Provisional Application No. 63/430,536 filed Dec. 6, 2022 entitled, "Storage System", which is incorporated by reference herein as if reproduced in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Storage systems, such as storage shelves or racks, are used to arrange and store various items. Storage systems are available in varying sizes and may be constructed using different materials depending on the characteristics of the items to be stored thereon.

SUMMARY

In one embodiment, a storage system is provided that includes a top, a bottom, a front, a back, a left side wall extending between the top and bottom, and a right side wall opposite the left side wall and extending between the top and bottom. A storage area is defined by the top, bottom, left and right side walls. The storage system includes a plurality of full shelves located within the storage area and extending between the left and right side walls, and a plurality of partial shelves located within the storage area, some of the plurality of partial shelves extending from the left side wall into the storage area and some of the plurality of partial shelves extending from the right side wall into the storage area. The storage system further includes a skirt extending around at least a portion of a lower side of the bottom of the storage system, the skirt extending from the bottom adjacent the front of the storage system a first distance, the skirt extending from the bottom adjacent the back of the storage system a second distance, the first distance being greater than the second distance.

In another embodiment, a system is provided that includes a first and second storage system. Each of the first and second storage systems comprising a top, a bottom, a front, a back, a left side wall extending between the top and bottom, a right side wall opposite the left side wall and extending between the top and bottom. A storage area is defined by the top, bottom, left and right side walls. Each storage system having a plurality of full shelves located within the storage area and extending between the left and right side walls, and a plurality of partial shelves located within the storage area, some of the plurality of partial shelves extending from the left side wall into the storage area and some of the plurality of partial shelves extending from the right side wall into the storage area. Each of the storage systems further having a skirt extending around at least a portion of a lower side of the bottom of the storage system, the skirt extending from the bottom adjacent the front of the storage system a first distance, the skirt extending from the bottom adjacent the back of the storage system a second distance, the first distance being greater than the second distance. The first storage system is stacked atop the second storage system such that the bottom of the first storage system abuts the top of the second storage system, and wherein skirt of the first storage system at least partially overlaps the top of the second storage system about the front, a left side, and a right side of the second storage system.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

While the present disclosure may be discussed with regard to particular applications in specific industries and with regard to storage of specific products, the present disclosure is not so limited and the storage systems disclosed herein may be employed in a wide variety of industries for storage of any suitable items. As merely one example of a specific application of the present system, the food service industry and restaurants in particular may find benefits to employing the present storage system because of the specific challenges faced by these businesses. For example, many restaurants have a large number of customer orders during peak periods, such as during lunch or dinner hours. In order to prepare for these "peak" periods, it may be useful for restaurants to prepare or stage food in advance of service to customers. Again, in one non-limiting example, restaurants that prepare pizzas may find it efficient to prepare or partially prepare numerous pizzas before these "peak" periods to reduce the final preparation time, such as cooking and packaging, once customer orders are actually received. However, there are various considerations when restaurants prepare and stage large numbers of items, such as pizzas. For example, storing numerous prepared pizzas consumes considerable space, yet space in restaurant kitchens and cold storage areas is limited. Further, the staged pizzas need to be easily visible and accessible to the restaurant staff so the staff can quickly and accurately identify and retrieve the correct pre-prepared pizza when needed, for example, for cooking. Also, food items should be stored in a manner that considers food safety requirements, such as being covered. These are merely examples of considerations for the design of storage systems, and in this specific example, systems that may store food items in restaurants. However, these examples are not intended to limit or otherwise define the storage system of the present disclosure. While the items to be stored in the storage system may be described, in various examples, as food stuff, or more specifically pizzas, one skilled in the art will appreciate that the present disclosure may be readily adapted to a myriad of other foods or non-food items, all of which are within the spirit and scope of the present disclosure.

Figure 1:
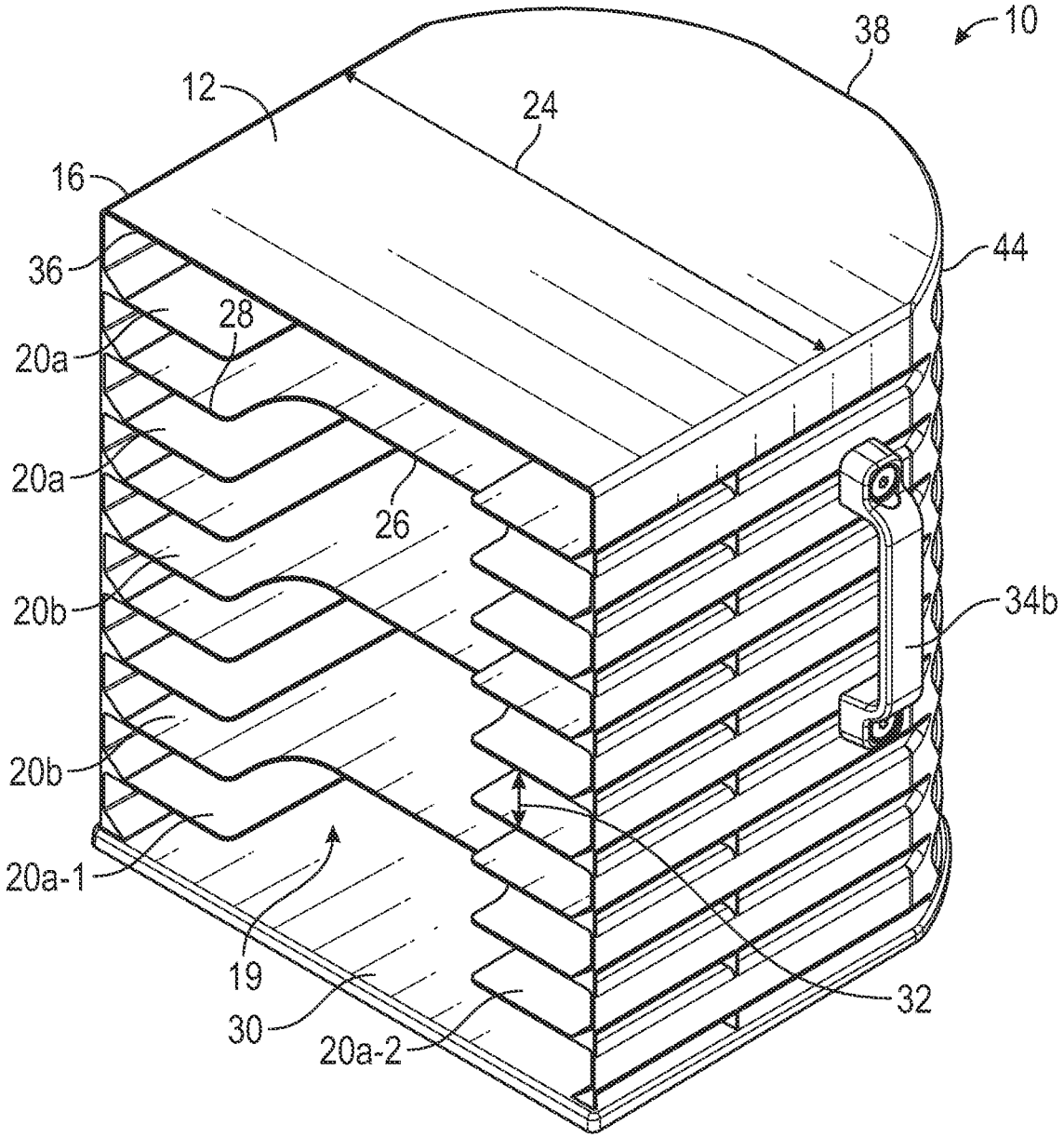
FIG. 1 is a top perspective view of a storage system according to one embodiment of the present disclosure.
Figure 2:
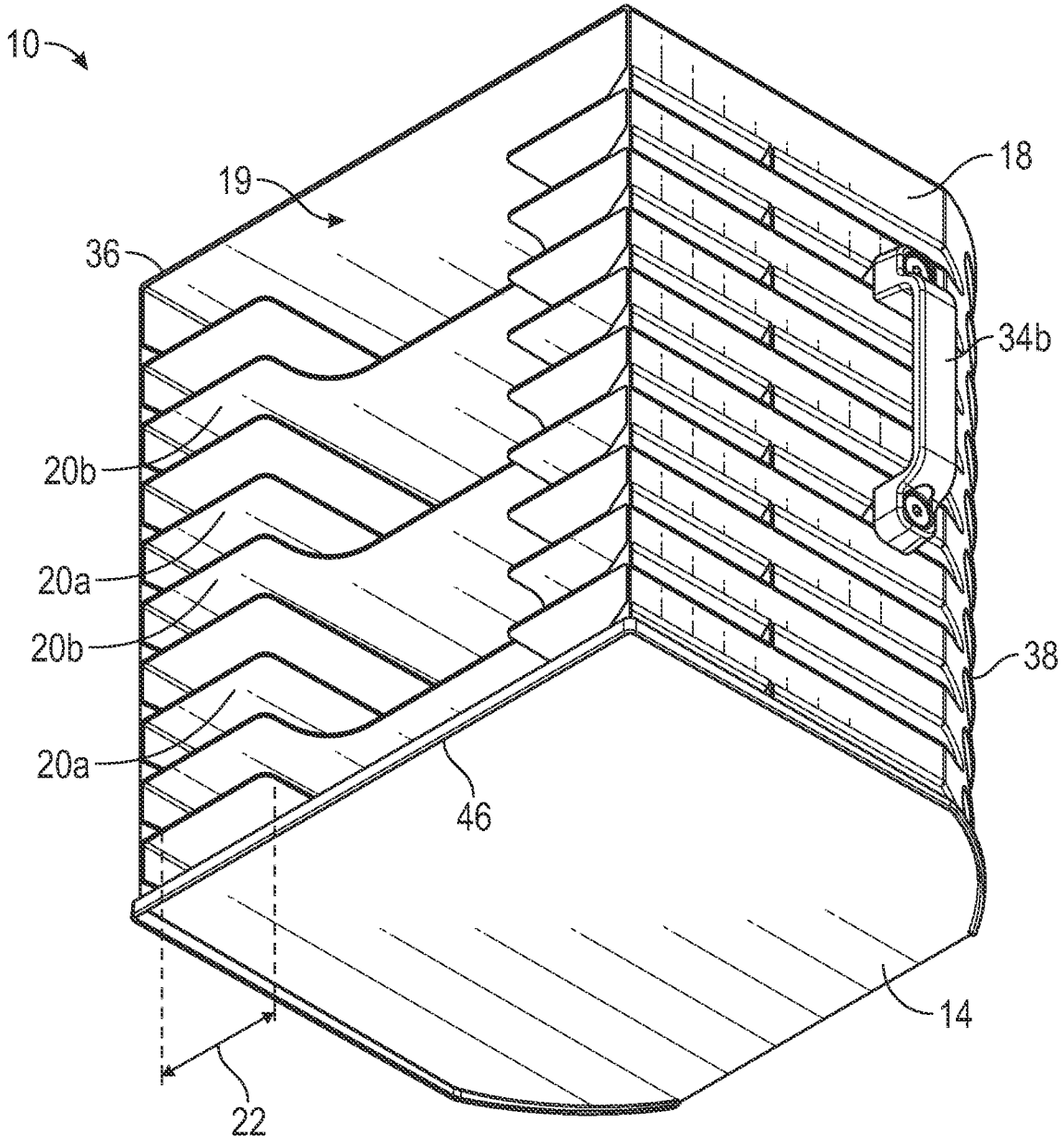
FIG. 2 is a bottom perspective view of the storage system according to one embodiment of the present disclosure.

FIGS. 1 and 2 are perspective views of an embodiment of a storage system 10 according to the present disclosure. The storage system 10 includes a top 12 and a bottom 14 that are substantially uniform flat surfaces. However, in other embodiments, the top 12 and bottom 14 may be otherwise configured, such as grooved or ribbed to provide added strength and structural support. The storage system 10 includes left and right side walls 16, 18, respectively. The top 12, bottom 14, and left and right side walls 16, 18 define a storage area 19 within the storage system 10. A plurality of shelves 20 (20*a* and 20*b*) extend from the left and right side walls 16, 18 into the storage area 19. Some of the shelves 20, such as partial shelves 20*a*, extend only partially into the storage area 19 from the left and right side walls 16, 18, while some of the shelves 20, such as full shelves 20*b*, extend entirely across the storage area 19 between the left and right side walls 16, 18. Instead of every shelf 20 being a full shelf 20*b*, the partial shelves 20*a* are intermittently provided to allow for greater visibility into the storage area 19 so that users can more readily identify the items stored therein.

The partial shelves 20*b* extend into the storage area 19 a first distance 22. The first distance 22 may be determined based on the particular items being stored in the storage system 10. For example, in this embodiment the first distance 22 is sized to accommodate multiple sizes of round pizza pans, which will be discussed in greater detail below. The first distance 22 may, for example, be sized such that the smallest size pan is supported on the left side of the pan by a left side partial shelf 20*a*-1 and on the right side of the pan by a right side partial shelf 20*a*-2. The total width or second distance 24 within the storage area 19 between left and right side walls 16, 18 may be sufficient to accommodate the largest size pizza pan within the storage area 19. In this way, the shelves 20 may accommodate multiple sized items, such as various sizes of pizza pans, which provides greater flexibility enabling storage of a wider range of items.

In some embodiments, the full shelves 20*b* may be useful to provide overall structural support for the storage system 10. Depending on size and weight of the items to be stored, more or fewer full shelves 20*b* may be employed. In some embodiments, for example to reduce construction cost and increase visibility, it may be advantageous to employ a minimum number of full shelves 20*b* while still providing the appropriate structural support for the storage system 10 when loaded with items. Since the full shelves 20*b* reduce visibility, in some embodiments, the full shelves 20*b* may have a notch 26 or be partially recessed along a front edge 28 between the left and right side walls 16, 18. The notch 26 may further enhance visibility while still providing sufficient structural support. Further, since the shelves 20 are sized to fit, for example, a large pizza or pizza pan, the notch 26 may also enhance the accessibility of small or medium size pizza or pizza pans located on the shelves 20.

In this embodiment, the storage system 10 is shown with nine (9) shelves 20 which, taking into account the inside upper surface 30 of the bottom 14, provides ten (10) storage locations. However, the storage system 10 may be sized to have any number of shelves 20 in other embodiments. The distance or height 32 between the shelves 20 may be determined based on the item being stored in the storage system 10. For example, the height 32 might be sized to accommodate a pizza placed on a tray, which would account for more shelves 20 in the storage system 10, while larger items might require more height 32 and thus fewer numbers of shelves 20.

Figure 3:
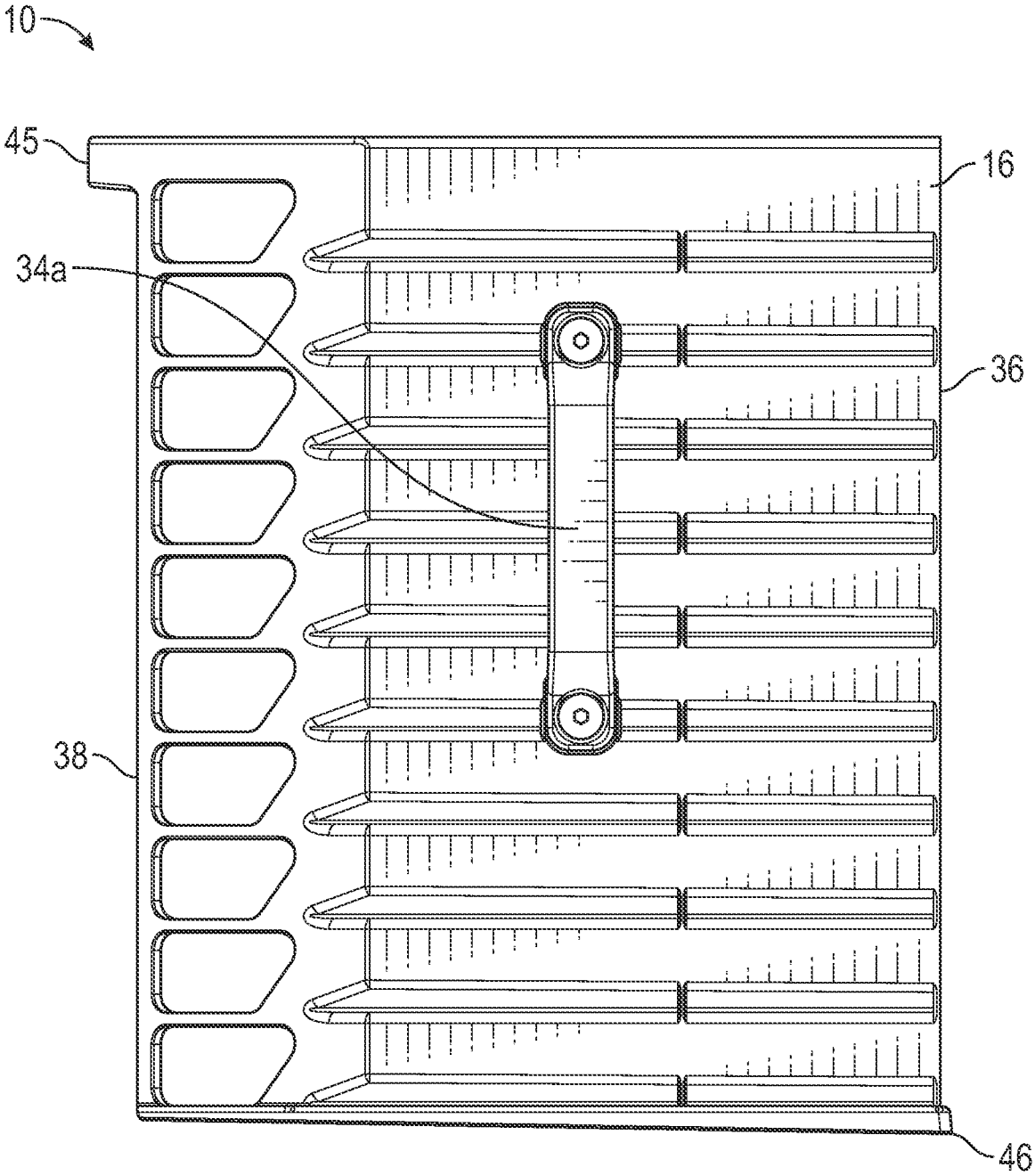
FIG. 3 is a left side view of the storage system according to one embodiment of the present disclosure.
Figure 4:
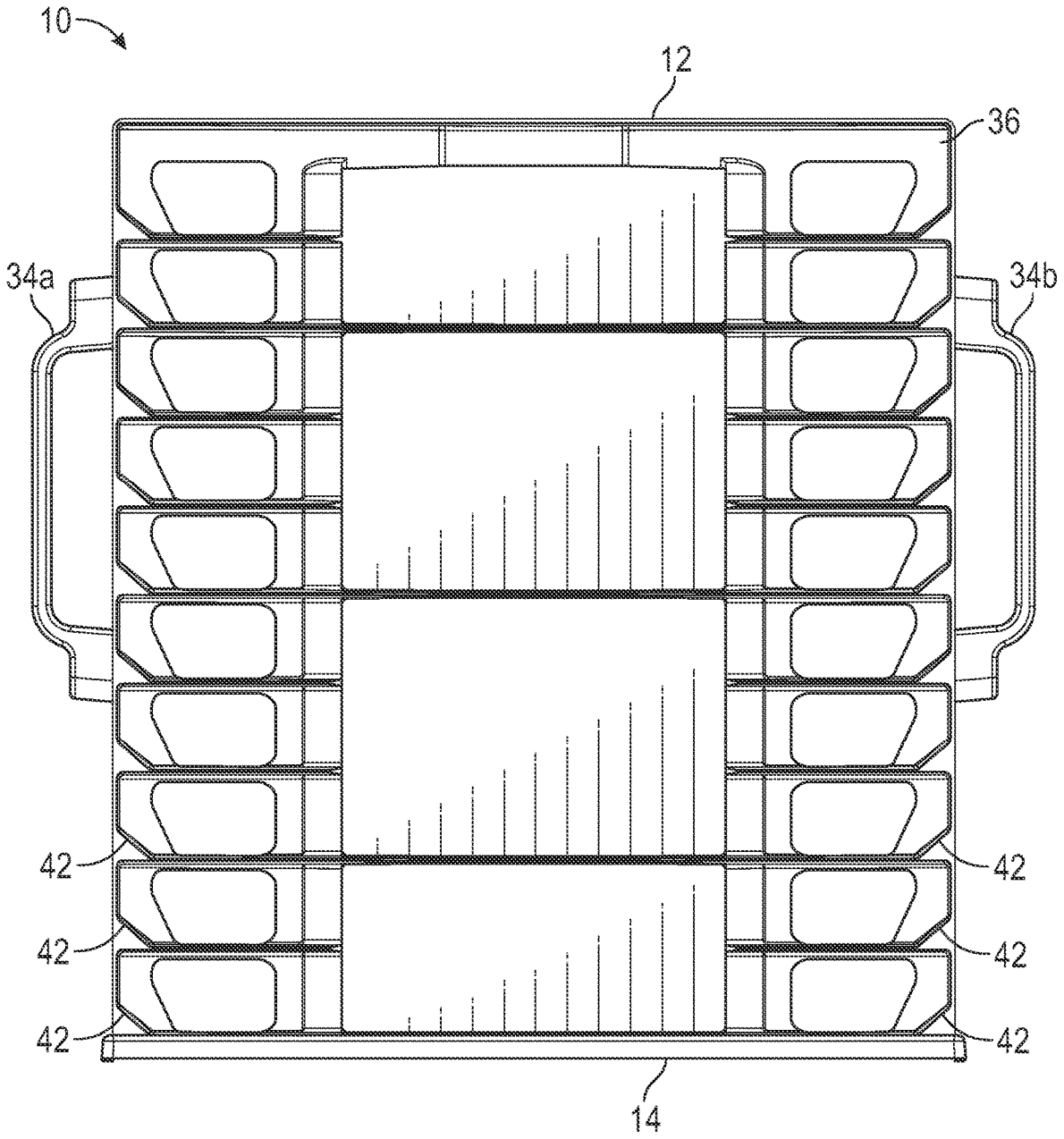
FIG. 4 is a front view of the storage system according to one embodiment of the present disclosure.
Figure 5:
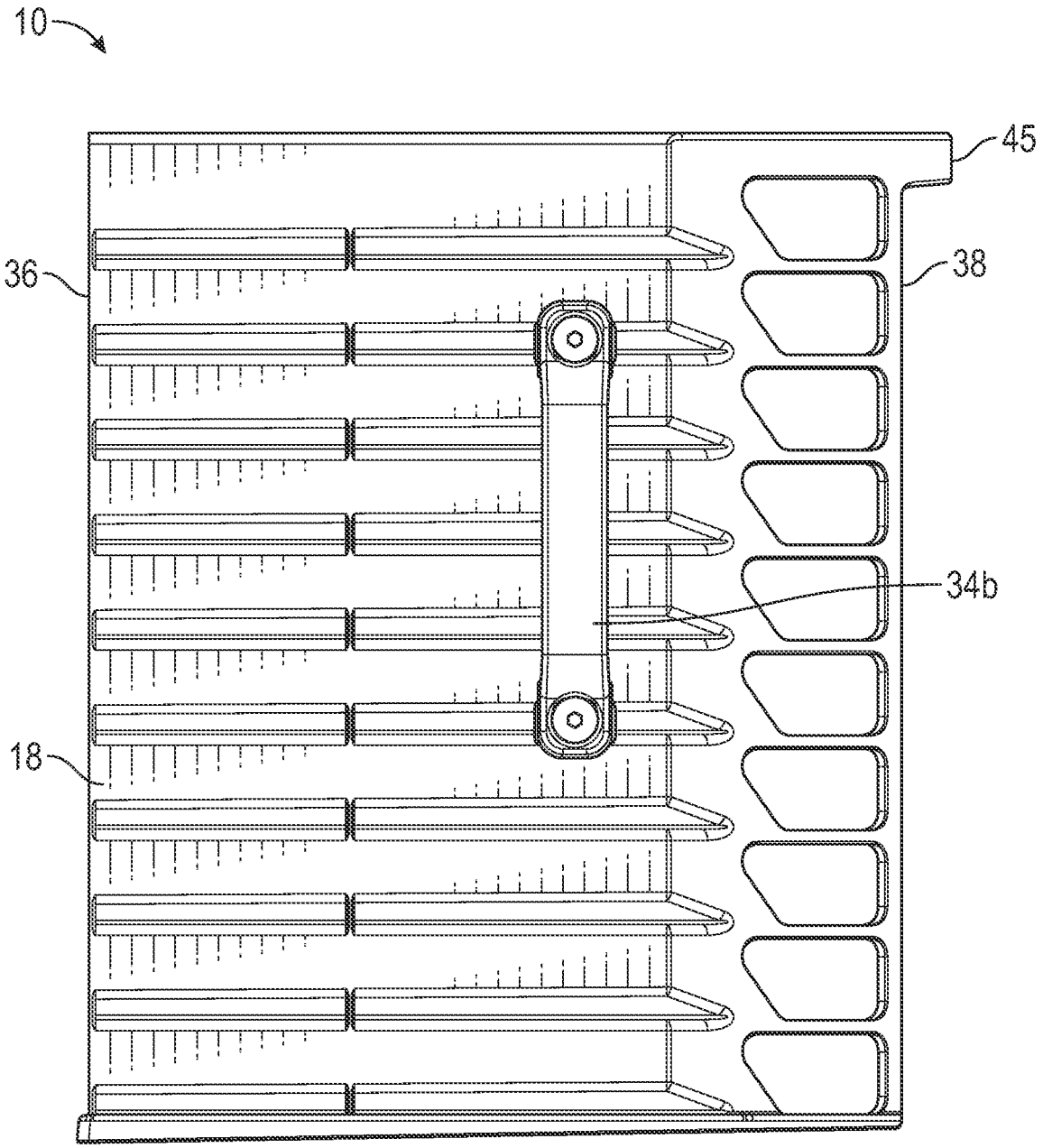
FIG. 5 is a right side view of the storage system according to one embodiment of the present disclosure.
Figure 7:
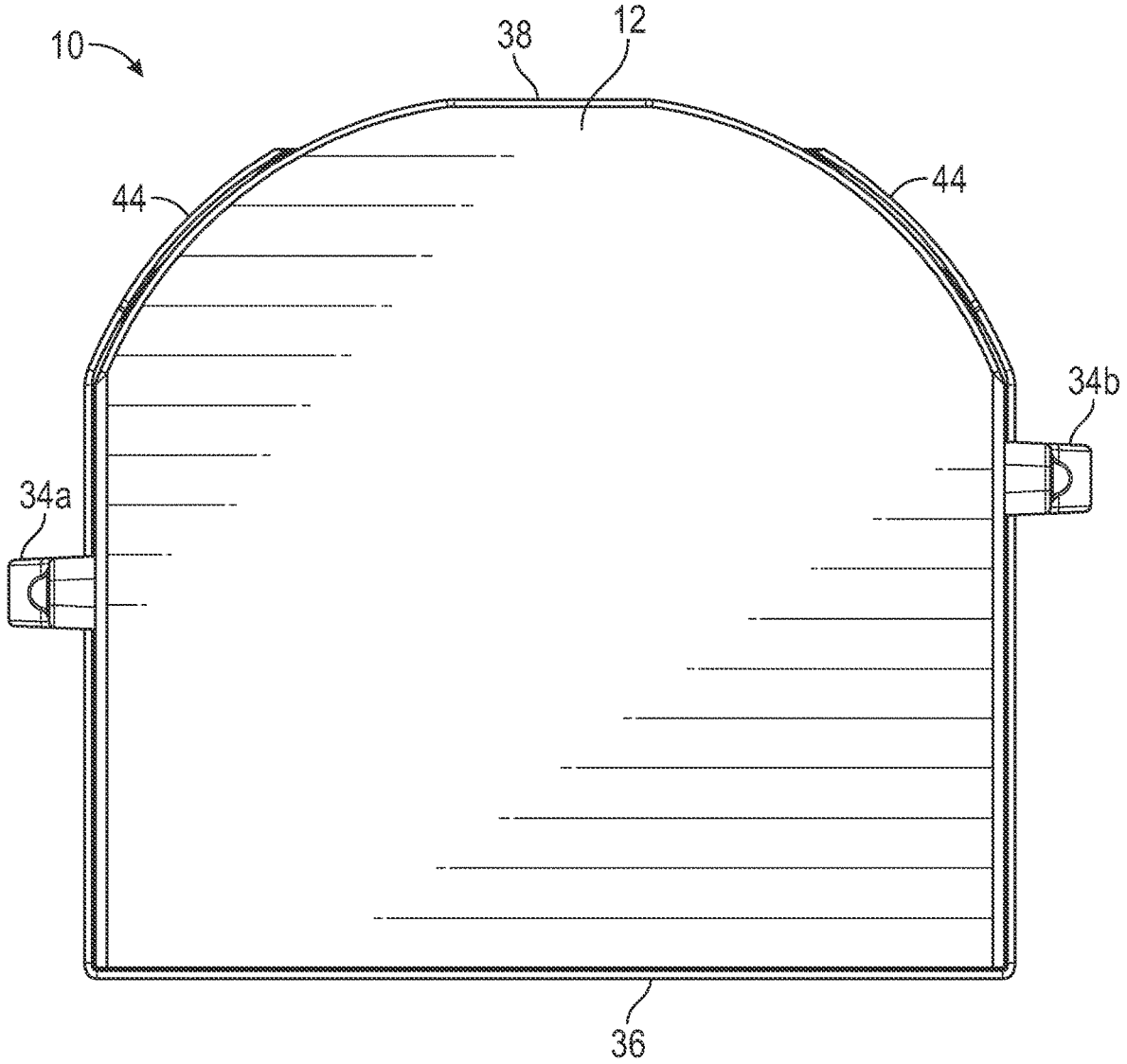
FIG. 7 is a top view of the storage system according to one embodiment of the present disclosure.
Figure 8:
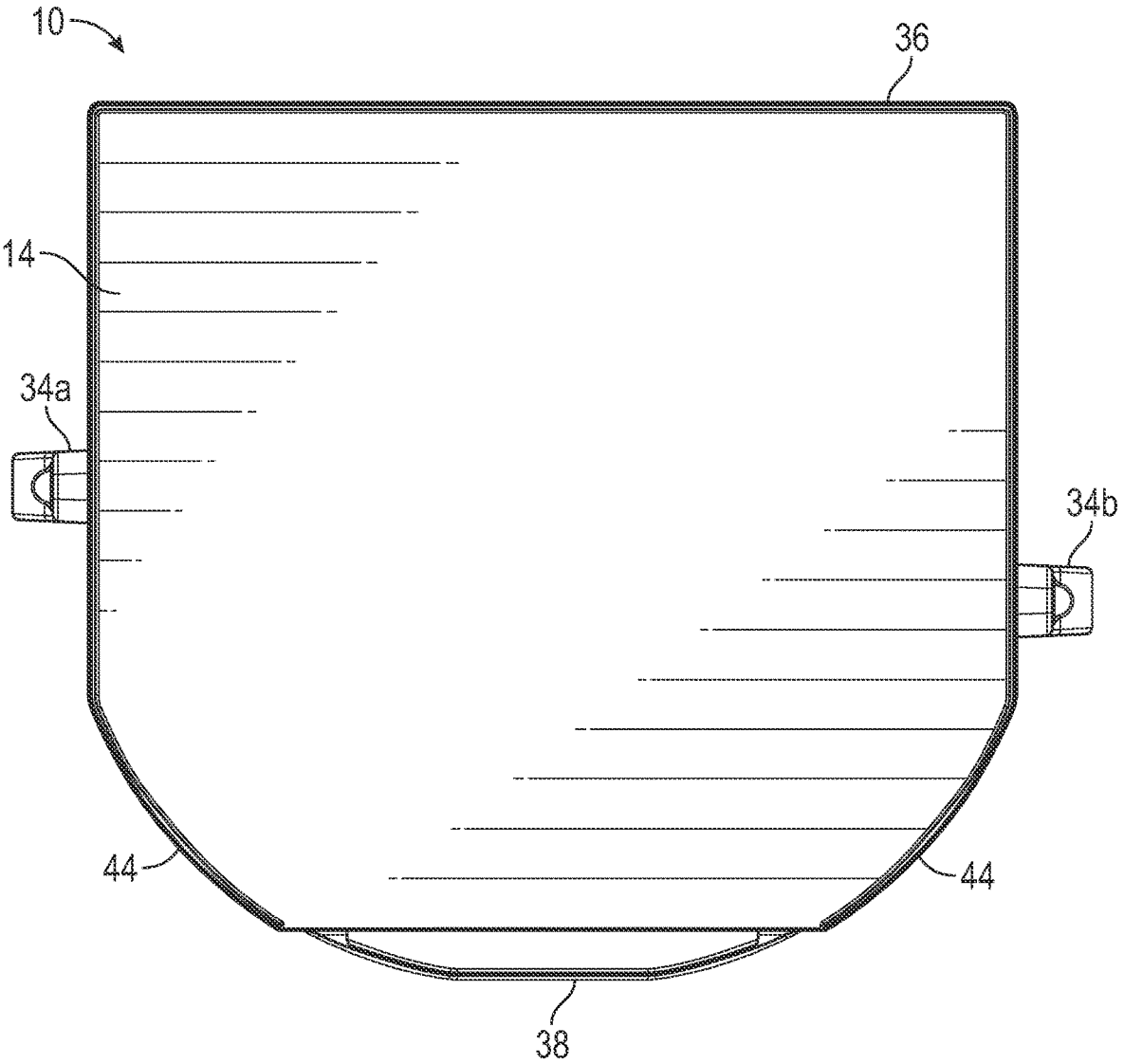
FIG. 8 is bottom view of the storage system according to one embodiment of the present disclosure.

Referring also to FIGS. 3-6, the storage system 10 also includes handles 34 (34*a* and 34*b*), a left handle 34*a* mounted on the left side wall 16 and a right handle 34*b* mounted on the right side wall 18. The handles 34 allow a user to readily grasp, lift, or move the storage system 10. In this embodiment, both handles 34 are shown as mounted at about the same height or vertical location relative to the top 12 and bottom 14. However, as can be seen in FIGS. 3 and 5 as well as FIGS. 7-8, the handles 34 are offset with respect to one another relative to a front 36 and back 38 of the storage system 10. For example, in this embodiment, the left handle 34*a* is positioned forward relative to the front 36 of the storage system 10, while the right handle 34*b* is positioned closer to the back 38 of the storage system 10. The offset positioning of the handles 34 provides space savings in situations where multiple storage systems 10 are positioned side-by-side. Instead of the handles 34 of adjacent storage systems 10 abutting one-another, this offset positioning of the handles 34 allows, for example, for the left handle 34*a* of a first storage system 10 not to contact the right handle 34*b* of a second storage system 10 adjacently located, and so on. Since space may be at a premium in locations such as restaurant kitchens and coolers, the offset positioning of the handles 34 may save valuable space. The handles 34 may be located elsewhere on the storage system 10 in other embodiments, such as not positioned offset as described above. In this embodiment, the handles 34 are removeable which may provide additional space savings when needed.

Figure 6:
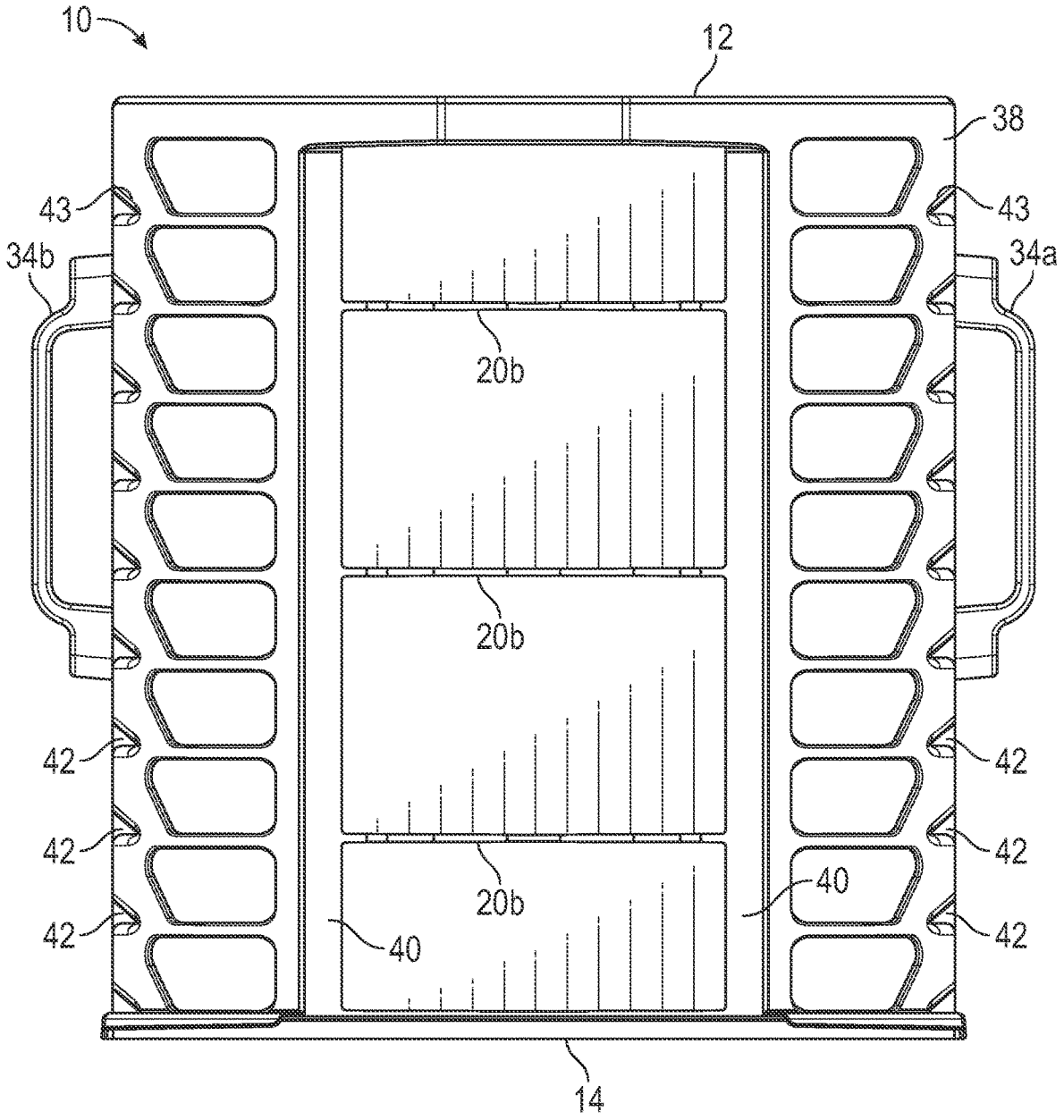
FIG. 6 is a back view of the storage system according to one embodiment of the present disclosure.

Referring to FIG. 6, a back view of the storage system 10 is shown. The full shelves 20*b* can be seen as extending horizontally near the back 38 of the storage system 10, while vertical supports 40 are shown extending vertically between the top 12 and bottom 14. The vertical supports 40 may be included to provide further structural integrity and support for the storage system 10. Further the vertical supports 40 prevent items on the shelves 20, such as pizza pans or trays, from sliding out of the back 38 of the storage system 10. In some embodiments, the full shelves 20*b* may extend to the back 38 of the storage system 10, while in other embodiments, the full shelves 20*b* may not extend completely to the back 38 and instead be notched near the back 38, similar to notch 26.

Referring also to FIG. 4, notably, other than the vertical supports 40 along the back 38, both the back 38 and front 36 of the storage system 10 are otherwise open or unobstructed, which may promote circulation of air for cooling or warming the items stored on the shelves 20 and may also be useful for cleaning the storage system 10. For example, in some embodiments, the storage system 10 may be sized so that storage system 10 may be placed in a commercial dishwasher for cleaning. Since the front 36 and back 38 are generally open, water or cleaning fluid may readily flow, unimpeded, from front 36 to back 38, or vice versa, through the storage area 19 to sanitize the storage system 10. Sanitization of the storage system 10 may be necessary in applications where food safety or other considerations apply. Furthermore, provisioning the storage system 10 with numerous partial shelves 20*a*, which provide more openness within the storage area 19 relative to the full shelves 20*b*, further enables water or cleaning fluids to readily flow through and clean the storage system 10 during dishwashing.

As can also be seen in FIGS. 4 and 6, gussets 42 may be used, in some embodiments, to provide further support of the connection of the shelves 20 to the left and right side walls 16, 18. Further, round pizza pans may have raised edges on the side that provide sufficient height to clear or raise above an angled portion 43 the gussets 42. Thus, in applications with such pizza pans, the gussets 42 do not interfere with or reduce the width-wise size of items to be stored and items may utilize the entire storage area 19 between the left and right side walls 16, 18 on each shelf 20.

As can be seen in this embodiment, the left and right side walls 16, 18 provide a solid barrier, which increases the structural stability of the storage system 10, but does not otherwise interfere with the cleanability of the storage system 10 due to the open design of the front 36 and back 38. Further the solid barriers provided by the left and right side walls 16, 18 may inhibit the flow of air which may be useful to prevent items, such as pizza dough for example, from drying out by being exposed to excessive amounts of airflow. As can be seen, the overall design of the storage system 10 provides for structural integrity and promotes cleanability, while not allowing excess airflow to negatively impact the items stored therein.

Referring to FIGS. 1-2 and 7-8, it can be seen that the front 36 of the storage system 10 is generally flat and perpendicular to the left and right side walls 16, 18, while the back 38 includes rounded edges 44. Although squared edges may be used in other embodiments, the rounded edges 44 may reduce construction materials and cost, and further enable the storage system 10 to more easily slide or fit into tighter locations than squared edges. Further, in embodiments where the items to be stored are generally round or rounded, such as round pizza pans and pizzas, the rounded edges 44 may provide these benefits without losing any usable storage space. Further, it can be seen that the top 12 is rounded which protects or covers the top of rounded items, such as food, which may be useful for food safety, as one example. As can be seen in FIGS. 3 and 5, the rounded top 12 includes a lip 45 that extends from the back 38 beyond the vertical supports 40, while the bottom 14 remains flush along the back 38 with the vertical supports 40. This shortened length, from front 36 to back 38, of the bottom 14 relative to the top 12, reduces the overall footprint or floor space consumed by the storage system 10 given the angled disposition of the storage system 10, as will be discussed in greater detail below. In situations where the storage system 10 may be located in areas where space is limited, maximizing the storage area 19 available for items, such as pizzas and pizza pans, while minimizing the overall dimensions of the storage system 10 is beneficial.

As illustrated in FIGS. 2 and 3, the bottom 14 of the storage system 10 may be provided with a skirt 46. The skirt 46 may extend partially around the edge of the bottom 14 and is larger or extends farther from the bottom 14 near the front 36 of the storage system 10 and gradually decreases and becomes flush with the bottom 14 near the back 38 of the bottom 14. The configuration of the skirt 46 thus angles or tilts the storage system 10 toward the back 38 such that the shelves 20 and top 12 of the storage system are generally backwardly angled when the storage system 10 is placed on a flat surface or ground. Thus, items positioned in the shelves 20 tend to gravitate or slide backward in the shelves 20. The skirt 46 may be configured to create an angle of one degree (1°) more or less in some embodiments, or greater or less than one degree (1°) in other embodiments, or two degrees (2°) or less in still other embodiments. Since the storage system 10 may be moved or transported, for example by lifting, rolling on a dolly or cart with rollers, or otherwise, items may tend to slide out of the front 36 when the storage system 10 is bumped, tilted, or abruptly stopped. Thus, by angling the storage system 10 lower toward the back 38, items on the shelves 20 are less likely to slide out of the front 36 of the storage system 10.

Figure 9:
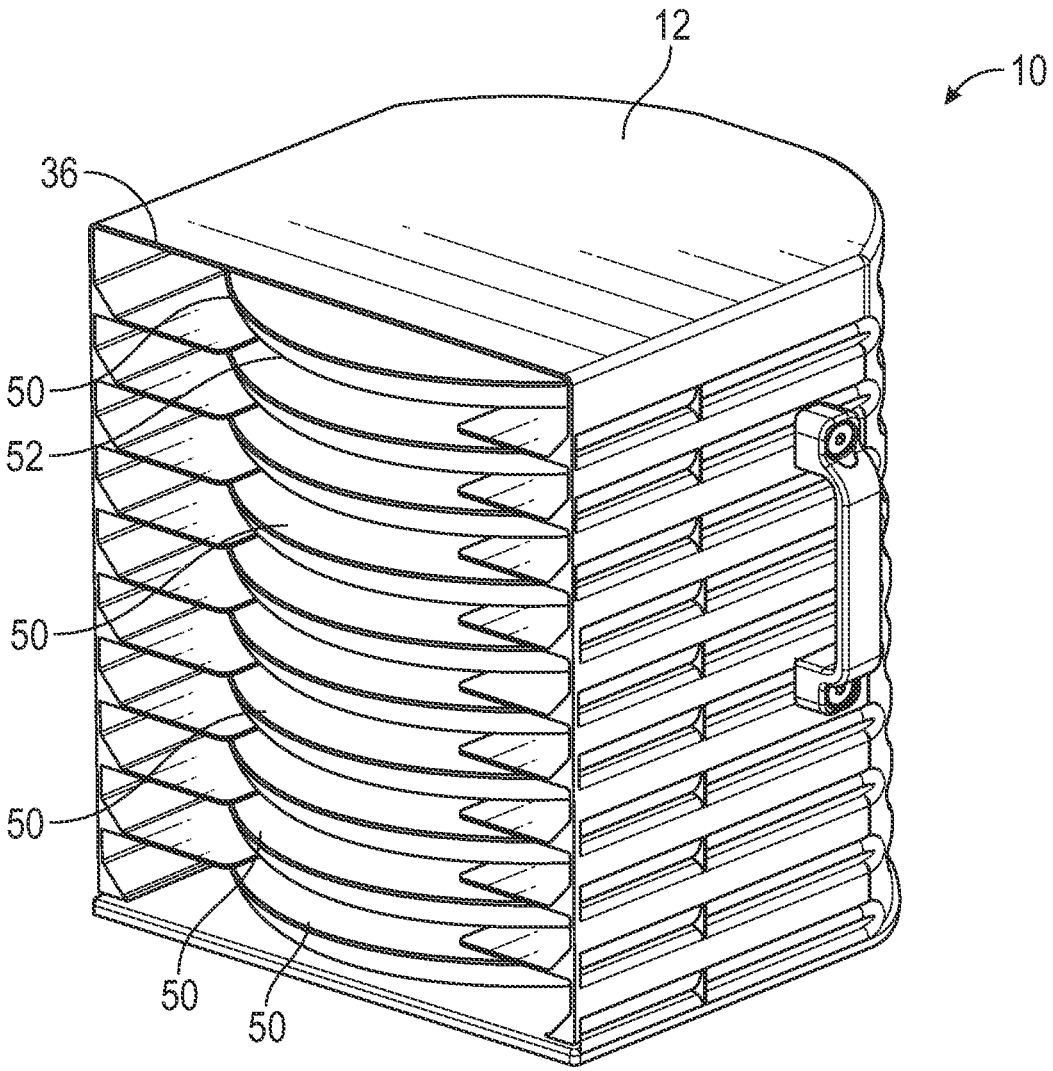
FIG. 9 is a side perspective view of the storage system according to one embodiment of the present disclosure.
Figure 10:
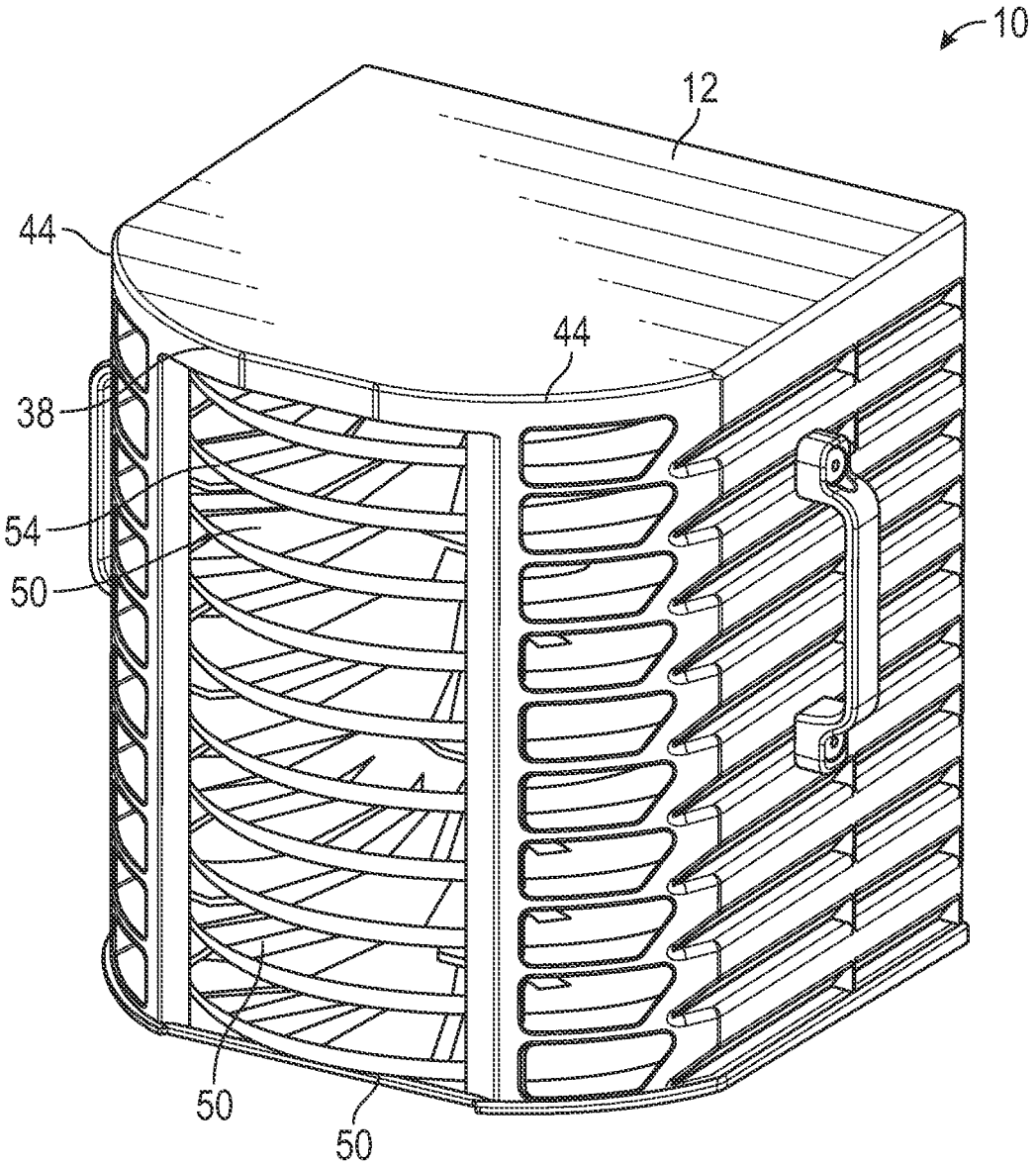
FIG. 10 is a back perspective view of according to one embodiment of the present disclosure.

FIGS. 9 and 10 illustrate a front and back view, respectively, of the storage system 10. In these illustrations, a plurality of trays 50 are shown positioned on shelves 20. The trays 50 are, in this example, round pans or trays 50 such as pizza pans. As can be seen in FIG. 9, the trays 50 are generally covered near a tray front 52 of the trays 50 by the top 12 along the front 36 of the storage system 10. Similarly, FIG. 10 illustrates the trays 50 being generally covered near a tray back 54 of the trays 50 along the back 38 of the storage system 10. The rounded edges 44 along the back 38 of the storage system 10 notably conform to and cover the trays 50 due to the rounded configuration of the trays 50.

Figure 11:
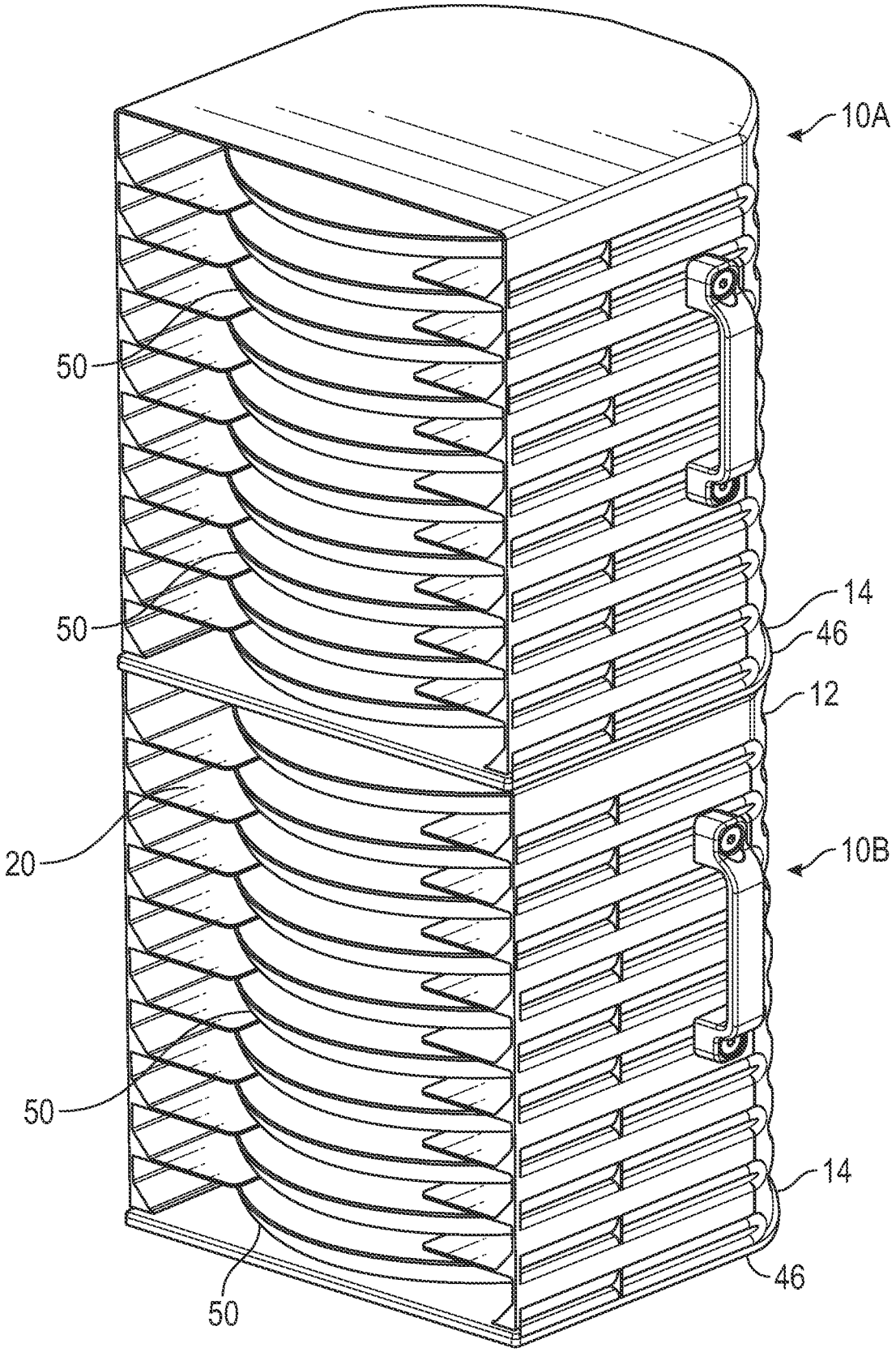
FIG. 11 is a side perspective view of stacked storage systems according to one embodiment of the present disclosure.
Figure 12:
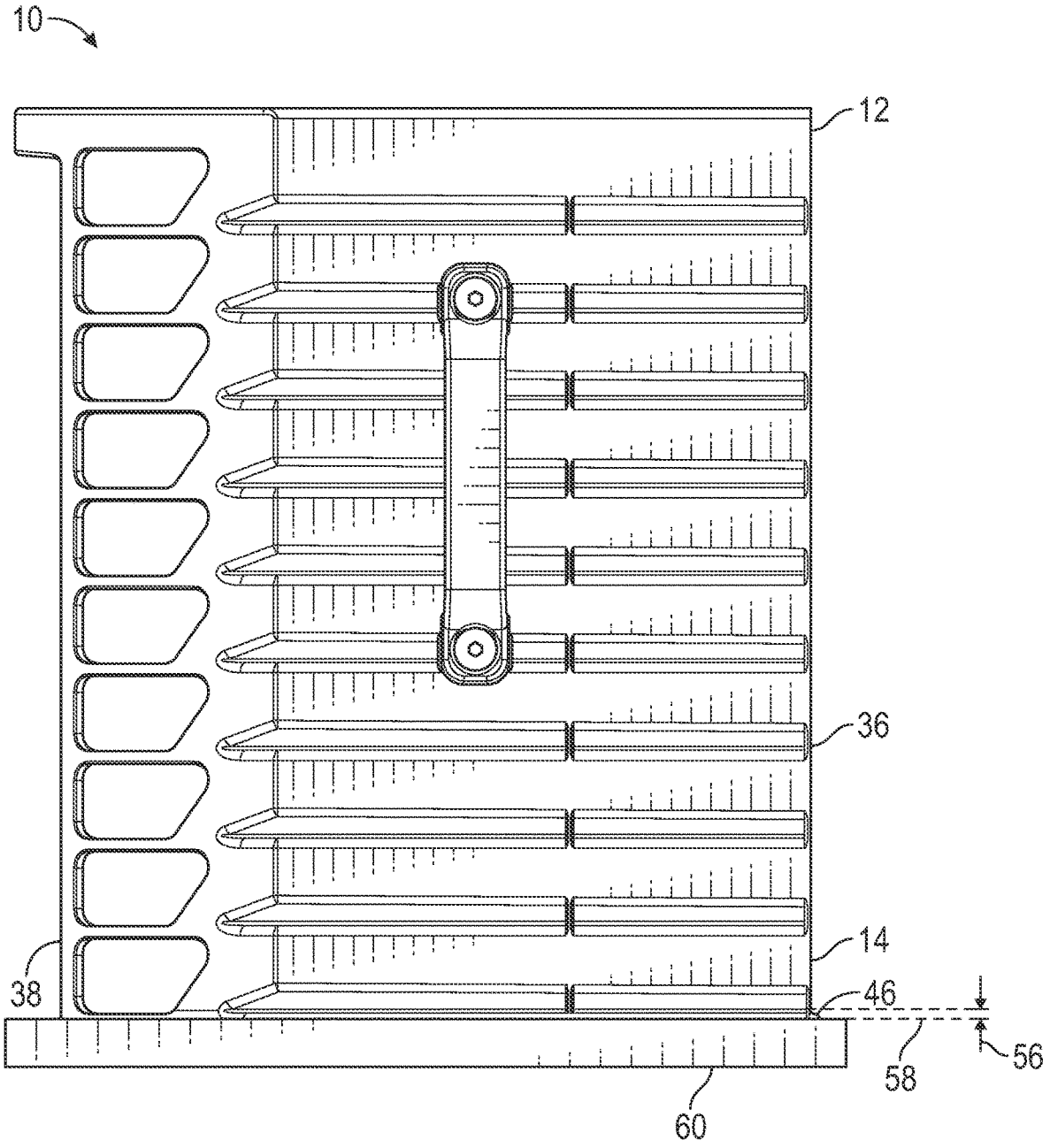
FIG. 12 is a side view of another embodiment of the storage system according to one embodiment of the present disclosure.
Figure 13:
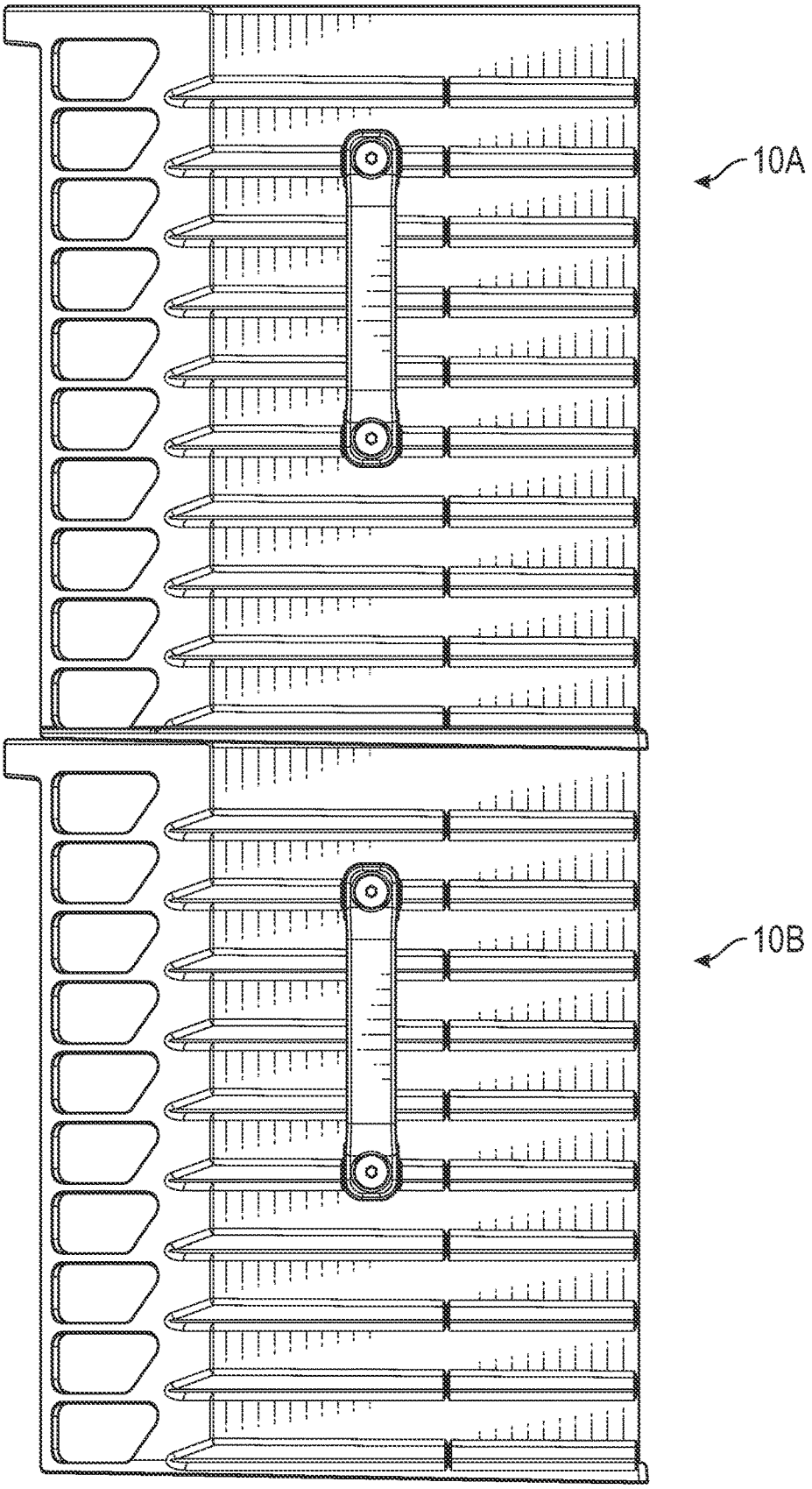
FIG. 13 is a side view of stacked storage systems according to one embodiment of the present disclosure.

FIG. 11 illustrates multiple storage systems 10 stacked on one another. In this embodiment, a first storage system 10A is shown stacked atop a second storage system 10B. Although two (2) storage systems 10 are shown, one stacked on another, any number of storage systems 10 may be stacked on one another. The bottom 14 and skirt 46 of each of the storage systems 10A and 10B are sized so that when the first storage system 10A is stacked on top of the second storage system 10B, the skirt 46 of the top or first storage system 10A extends over and around the top 12 of the bottom or second storage system 10B. Referring also to FIG. 12, in this way, the skirt 46 of the bottom or second storage system 10B creates an angle 56, such as 1 degree relative to a ground plane 58 along a surface or ground 60, to backwardly angle the disposition of the bottom or second storage system 10B, but the skirt 46 mating of the top or first storage system 10A does not further exaggerate the angle 56 of subsequently stacked storage systems 10. This top 12, bottom 14, skirt 46 configuration and mating causes the 1 degree angle to be maintained regardless of the number of stacked storage systems 10. It will be appreciated that even at a one degree (1°) angle, when multiple stacked storage systems 10 are positioned against a wall, for example, the top 12 back 38 of the top most storage system 10 would abut the wall while the bottom 14 back 38 of the lowest storage system 10 would be located away from the wall. Thus, the skirt 46 configuration maintains the about one degree (1°) angle throughout stacked storage systems 10 while not wasting excess space behind the stacked storage systems 10 that would otherwise be lost by ever increasing the angle in absence of this overlapping skirt 46 configuration. Further, because skirt 46 extends over the top 12 of a lower or second storage system 10B, additional space or height may be provided for the top shelf 20 of the second storage system 10B so that the top shelf 20 has the same clearance or overall height as the other shelves 20 given the overlap of the skirt 46 of the first storage system 10A stacked above. Again, while this space savings may be relatively minor, in areas such as walk-in coolers, standup coolers or retarders, and other locations and systems in restaurants or other constrained space locations, this may save valuable space. FIG. 13 illustrates a side view of the first and second storage systems 10A and 10B shown stacked one atop the other to further illustrate the angled disposition of multiple stacked storage systems 10.

Figure 14:
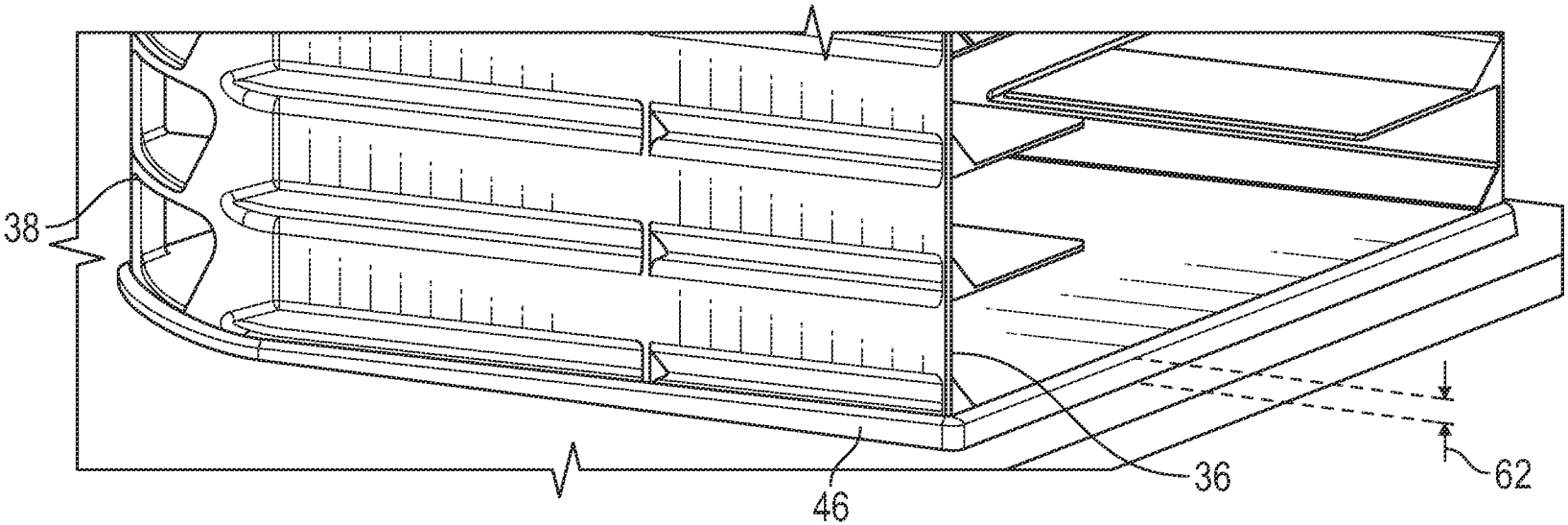
FIG. 14 is a partial view of the storage system according to one embodiment of the present disclosure.

FIG. 14 is a partial view of an embodiment of the storage system 10. As can be seen in FIG. 14, a depth or height 62 of the skirt 46 is greater near the front 36 of the storage system 10 and gradually diminishes toward the back 38 of the storage system 10. This configuration provides for the backwardly angled disposition of the storage system 10 as discussed above. Again, while the skirt 46 is configured to provided an angle of about one degree (1°), the skirt 46 may be configured to provided a greater or lesser angle, in other embodiments.

The storage system 10 may be constructed from various materials such as steel, plastic, or other known materials. In some embodiments, the storage system 10 may be formed by injection molding using polymeric materials such as copolymer polypropylene.

In one embodiment, a storage system is provided that includes a top, a bottom, a front, a back, a left side wall extending between the top and bottom, and a right side wall opposite the left side wall and extending between the top and bottom. A storage area is defined by the top, bottom, left and right side walls. The storage system includes a plurality of full shelves located within the storage area and extending between the left and right side walls, and a plurality of partial shelves located within the storage area, some of the plurality of partial shelves extending from the left side wall into the storage area and some of the plurality of partial shelves extending from the right side wall into the storage area. The storage system further includes a skirt extending around at least a portion of a lower side of the bottom of the storage system, the skirt extending from the bottom adjacent the front of the storage system a first distance, the skirt extending from the bottom adjacent the back of the storage system a second distance, the first distance being greater than the second distance.

In some embodiments, the first distance is greater than the second difference of the skirt such that at least one of the top or the plurality of full and partial shelves angle backwardly from the front of the storage system toward the back of the storage system at an angle of about two degrees (2°) or less. In other embodiments, the first distance is greater than the second difference of the skirt such that the top of the storage system angles backwardly from the front of the storage system toward the back of the storage system at an angle of about one degree (1°).

In some embodiments, the plurality of full shelves include a notched portion adjacent the front of the storage system such that a left and a right side of each of the plurality of full shelves extends a first shelf distance from adjacent the front to adjacent the back of the storage system, and wherein the notch portion is located between the left and right sides and extends a second shelf distance from adjacent the front to adjacent the back of the storage system, the first shelf distance being greater than the second shelf distance. While in other embodiments, a first of the plurality of partial shelves is located above a first of the plurality of full shelves, and a second of the plurality of partial shelves is located below the first of the plurality of full shelves. In still other embodiments, at least a first of the plurality of full shelves is located above a first and a second of the plurality of partial shelves and wherein a second of the plurality of full shelves is located below the first and second of the plurality of partial shelves.

In some embodiments, the storage system further includes a first handle located on an outside of the right side wall, and a second handle located on an outside of the left side wall. In other embodiments, the first and second handles are removable. In still other embodiments, the first handle is located on the right side wall a first handle distance from the front of the storage system, and wherein the second handle is located on the left side wall a second handle distance from the front of the storage system, wherein the first and second handle distances are different.

In some embodiments, the storage system is configured to stack atop a second storage system such that the skirt of the storage system is configured to at least partially overlap a top of the second storage about a front, a left side, and a right side of the second storage system when the top of the second storage system is sized substantially similar to the top of the storage system. In other embodiments, the skirt is sized to and extends adjacent the bottom of the storage system about the first side, the second side, and the front of the storage system to receive a top portion of a second substantially similar storage system.

In some embodiments, a first and second storage system may be stacked. In such cases, wherein the first distance is greater than the second difference of the skirt such that at least one of the tops or the plurality of full and partial shelves of the first and second storage systems angle backwardly from the front of the first and second storage systems toward the back of the first and second storage systems at an angle of about one degree (1°).

In some embodiments, the plurality of full shelves include a notched portion adjacent the front of the first and second storage systems such that a left and a right side of each of the plurality of full shelves extends a first shelf distance from adjacent the front to adjacent the back of the first and second storage systems and wherein the notch portion is located between the left and right sides and extends a second shelf distance from adjacent the front to adjacent the back of the first and second storage systems, the first shelf distance being greater than the second shelf distance. In other embodiments, for each of the first and second storage systems a first of the plurality of partial shelves is located above a first of the plurality of full shelves, and a second of the plurality of partial shelves is located below the first of the plurality of full shelves. In still other embodiments, for each of the first and second storage systems at least a first of the plurality of full shelves is located above a first and a second of the plurality of partial shelves and wherein a second of the plurality of full shelves is located below the first and second of the plurality of partial shelves.

In other embodiments, the first and second storage systems further include a first handle located on an outside of the right side wall, and a second handle located on an outside of the left side wall. The first and second handles may be removable. In some embodiments, the first handle is located on the right side wall a first handle distance from the front of the first and second storage systems and wherein the second handle is located on the left side wall a second handle distance from the front of the first and second storage systems, wherein the first and second handle distances are different.

In some embodiments, each of the first and second storage systems further include a first and second back support members extending along the back between the top and the bottom, the first support member adjacent the right side and the second support member adjacent the left side, and wherein the top is substantially straight along the back between the first and second support members and curved between the first support member and the right side and the second support member and the left side.

In some embodiments, each of the first and second storage systems further comprise a plurality of gussets each connected adjacent the right and left side walls coupled to support each of the plurality of full and partial shelves.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A storage system, comprising:

a top, a bottom, a front, and a back;

a left side wall extending between the top and bottom;

a right side wall opposite the left side wall and extending between the top and bottom;

a storage area defined by the top, bottom, left and right side walls;

a plurality of full shelves located within the storage area and extending between the left and right side walls;

a plurality of partial shelves located within the storage area, some of the plurality of partial shelves extending from the left side wall into the storage area and some of the plurality of partial shelves extending from the right side wall into the storage area; and a skirt extending around at least a portion of a lower side of the bottom of the storage system, the skirt extending from the bottom adjacent the front of the storage system a first distance, the skirt extending from the bottom adjacent the back of the storage system a second distance, the first distance being greater than the second distance.

2. The storage system of claim 1, wherein the first distance is greater than the second distance of the skirt such at least one of the top or the plurality of full and partial shelves angle backwardly from the front of the storage system toward the back of the storage system at an angle of about two degrees (2°) or less.

3. The storage system of claim 1, wherein the first distance is greater than the second distance of the skirt such that the top of the storage system angles backwardly from the front of the storage system toward the back of the storage system at an angle of about one degree (1°).

4. The storage system of claim 1, wherein the plurality of full shelves include a notched portion adjacent the front of the storage system such that a left and a right side of each of the plurality of full shelves extends a first shelf distance from adjacent the front to adjacent the back of the storage system and wherein the notch portion is located between the left and right sides and extends a second shelf distance from adjacent the front to adjacent the back of the storage system, the first shelf distance being greater than the second shelf distance.

5. The storage system of claim 1, wherein a first of the plurality of partial shelves is located above a first of the plurality of full shelves, and a second of the plurality of partial shelves is located below the first of the plurality of full shelves.

6. The storage system of claim 1, wherein at least a first of the plurality of full shelves is located above a first and a second of the plurality of partial shelves and wherein a second of the plurality of full shelves is located below the first and second of the plurality of partial shelves.

7. The storage system of claim 1, further comprising:

a first handle located on an outside of the right side wall; and a second handle located on an outside of the left side wall.

8. The storage system of claim 7, wherein the first and second handles are removable.

9. The storage system of claim 7, wherein the first handle is located on the right side wall a first handle distance from the front of the storage system and wherein the second handle is located on the left side wall a second handle distance from the front of the storage system, wherein the first and second handle distances are different.

10. The storage system of claim 1, wherein the storage system is configured to stack atop a second storage system such that the skirt of the storage system is configured to at least partially overlap a top of the second storage system about a front, a left side, and a right side of the second storage system when the top of the second storage system is sized substantially similar to the top of the storage system.

11. The storage system of claim 1, wherein the skirt is sized to and extends adjacent the bottom of the storage system about the first side, the second side, and the front of the storage system to receive a top portion of a second substantially similar storage system.

12. A system, comprising:

a first and second storage system, each comprising:

a top, a bottom, a front, and a back;

a left side wall extending between the top and bottom;

a right side wall opposite the left side wall and extending between the top and bottom;

a storage area defined by the top, bottom, left and right side walls;

a plurality of full shelves located within the storage area and extending between the left and right side walls;

a plurality of partial shelves located within the storage area, some of the plurality of partial shelves extending from the left side wall into the storage area and some of the plurality of partial shelves extending from the right side wall into the storage area; and a skirt extending around at least a portion of a lower side of the bottom of the storage system, the skirt extending from the bottom adjacent the front of the storage system a first distance, the skirt extending from the bottom adjacent the back of the storage system a second distance, the first distance being greater than the second distance;

wherein the first storage system is stacked atop the second storage system such that the bottom of the first storage system abuts the top of the second storage system, and wherein the skirt of the first storage system at least partially overlaps the top of the second storage system about the front, a left side, and a right side of the second storage system.

13. The system of claim 12, wherein the first distance is greater than the second distance of the skirt such that at least one of the tops or the plurality of full and partial shelves of the first and second storage systems angle backwardly from the front of the first and second storage systems toward the back of the first and second storage systems at an angle of about one degree (1°).

14. The system of claim 12, wherein the plurality of full shelves include a notched portion adjacent the front of the first and second storage systems such that a left and a right sides of each of the plurality of full shelves extends a first shelf distance from adjacent the front to adjacent the back of the first and second storage systems and wherein the notch portion is located between the left and right sides and extends a second shelf distance from adjacent the front to adjacent the back of the first and second storage systems, the first shelf distance being greater than the second shelf distance.

15. The system of claim 12, wherein for each of the first and second storage systems a first of the plurality of partial shelves is located above a first of the plurality of full shelves, and a second of the plurality of partial shelves is located below the first of the plurality of full shelves.

16. The system of claim 12, wherein for each of the first and second storage systems at least a first of the plurality of full shelves is located above a first and a second of the plurality of partial shelves and wherein a second of the plurality of full shelves is located below the first and second of the plurality of partial shelves.

17. The system of claim 12, wherein each of the first and second storage system further comprise:

a first handle located on an outside of the right side wall; and a second handle located on an outside of the left side wall.

18. The system of claim 17, wherein the first and second handles are removable.

19. The system of claim 17, wherein the first handle is located on the right side wall a first handle distance from the front of the first and second storage systems and wherein the second handle is located on the left side wall a second handle distance from the front of the first and second storage systems, wherein the first and second handle distances are different.

20. The system of claim 12, wherein each of the first and second storage systems further comprise:

a first and second back support members extending along the back between the top and the bottom, the first support member adjacent the right side and the second support member adjacent the left side; and wherein the top is substantially straight along the back between the first and second support members and curved between the first support member and the right side and the second support member and the left side.

* * * * *